US007098609B2

(12) United States Patent
Suzuki et al.

(10) Patent No.: US 7,098,609 B2
(45) Date of Patent: Aug. 29, 2006

(54) DISCHARGE LAMP DRIVING CIRCUIT PROVIDED WITH DISCHARGE DETECTING PATTERN

(75) Inventors: Shinichi Suzuki, Shizuoka-ken (JP); Hiroshi Imada, Shizuoka-ken (JP)

(73) Assignee: Minebea Co., Ltd., Nagano-Ken (JP)

( * ) Notice: Subject to any disclaimer, the term of this patent is extended or adjusted under 35 U.S.C. 154(b) by 0 days.

(21) Appl. No.: 11/007,712

(22) Filed: Dec. 7, 2004

(65) Prior Publication Data

US 2005/0134199 A1 Jun. 23, 2005

(30) Foreign Application Priority Data

Dec. 18, 2003 (JP) ..... 2003-420247

(51) Int. Cl.
*G05F 1/00* (2006.01)

(52) U.S. Cl. ..... 315/291; 315/209 R; 315/308

(58) Field of Classification Search ..... 315/209 R, 315/209 PZ, 307, 219, 224, 291, 308, DIG. 7; 310/316.01
See application file for complete search history.

(56) References Cited

U.S. PATENT DOCUMENTS 5,654,611 A * 8/1997 Yamamoto et al. ..... 315/308
6,153,962 A * 11/2000 Noma et al. ..... 310/316.01
6,281,636 B1 * 8/2001 Okutsu et al. ..... 315/209 R
6,340,870 B1 * 1/2002 Yamashita et al. ..... 315/308
6,774,580 B1 8/2004 Suzuki ..... 315/224

FOREIGN PATENT DOCUMENTS

JP 2002-341775 11/2002
JP 2003-168585 6/2003

* cited by examiner

*Primary Examiner*—Tuyet Vo
*Assistant Examiner*—Jimmy Vu
(74) *Attorney, Agent, or Firm*—Muirhead & Saturnelli, LLC

(57) ABSTRACT

In a discharge lamp driving circuit comprising: a transformer having one end of a discharge lamp connected to one end of the secondary side thereof; a current-voltage converting circuit provided at the other end of the discharge lamp and functioning to convert a lamp current to a voltage; and a lamp current controlling pattern provided at the other end of the discharge lamp, there is provided a discharge detecting pattern at a grounding end of the secondary side of the transformer so as to be located close to and in parallel with the lamp current controlling pattern, whereby a voltage induced in the discharge detecting pattern is detected, and the supply of electric power to the secondary side of the transformer is stopped. Thus, the discharge lamp driving circuit is deactivated when a discharge occurs at the wiring at the secondary side of the high-voltage transformer.

20 Claims, 6 Drawing Sheets

DISCHARGE LAMP DRIVING CIRCUIT PROVIDED WITH DISCHARGE DETECTING PATTERN

BACKGROUND OF THE INVENTION

1. Field of the Invention

The present invention relates to a discharge lamp driving circuit for lighting a discharge lamp to illuminate a liquid crystal display (LCD) apparatus, and more specifically to a discharge lamp driving circuit provided with a function of detecting electric discharges, such as an arc discharge, and a corona discharge, that occur in the circuit.

2. Description of the Related Art

A backlight system has been generally used as a lighting device for an LCD apparatus. The backlight system comprises: one or more discharge lamp, such as a cold cathode lamp and a metal halide lamp; and a discharge lamp driving circuit composed of various circuits, such as an inverter circuit to drive the discharge lamp. Since a high voltage is required for lighting the discharge lamp, the discharge lamp driving circuit has a high-voltage transformer, and the discharge lamp is connected to the secondary side of the high-voltage transformer. The discharge lamp driving circuit is equipped with a protector by which the circuit is deactivated, for example, when a lamp current flowing in the discharge lamp has an abnormally high value. In such a discharge lamp driving circuit, when a lamp current flowing in the discharge lamp exceeds a predetermined value and it is duly detected, a protection circuit is activated thereby preventing an overcurrent from flowing in the discharge lamp (refer to, for example, Japanese Patent Application Laid-Open No. 2003-168585).

FIG. 1 is a block diagram showing a discharge lamp driving circuit 50 disclosed in the aforementioned Japanese Patent Application Laid-Open No. 2003-168585. In the circuit 50, the primary side of a transformer 51 is connected to an H-bridge circuit 52 which drives the primary side of the transformer 51, and to which a logic circuit 53 to produce a signal to be sent to the H-bridge 52 is connected, while the secondary side of the transformer 51 is connected to a discharge lamp 54, and also to a protection circuit 55 which, when a voltage of a signal 56 at the secondary side of the transformer 51 exceeds a predetermined value, deactivates the logic circuit 53 thereby preventing an overcurrent from flowing in the discharge lamp 54.

Since s discharge lamp used in a backlight system as a lighting device for an LCD apparatus must be driven by a high voltage, a high-voltage transformer is provided in a discharge lamp driving circuit. So, if a withstand voltage is lowered due to poor connection of a wiring to the secondary terminal of the transformer, breakage of a wiring at the secondary side of the transformer, poor connection between connector terminals for the discharge lamp, defective wires of the discharge lamp, or poor insulation of coils in the transformer, then an arc discharge, or a corona discharge can occur at some small gaps or voids found at the defective or poor areas. The arc discharge is accompanied by sparks, and may damage terminals and components, or even cause smoking or firing, resulting in possibly damaging the discharge lamp driving circuit and the LCD apparatus. Therefore, in a discharge lamp driving circuit provided with a high-voltage transformer, it is necessary to detect a corona discharge or an arc discharge, and to stop supplying electric power to a discharge lamp upon detection of such discharges thereby preventing damages to the circuit and the LCD apparatus.

In the discharge lamp driving circuit 50 described above, the logic circuit 53 is deactivated when the voltage of the signal 56 at the secondary side of the transformer 51 exceeds a predetermined value, whereby an overcurrent is prevented from flowing in the discharge lamp 54. However, since the discharge lamp 54 is kept on lighting even if a corona discharge or an arc discharge occurs at partially broken wires at the secondary side of the transformer 51, the lamp current is kept at a constant value, and therefore the protection circuit 55 fails to duly function. Thus, the discharge cannot be detected.

It is required that a discharge occurring at partially broken wires at the secondary side of a high-voltage transformer be detected in order to stop supply of electric power for the purpose of protecting the circuit. Under the circumstances, a discharge lamp driving circuit is proposed, in which a corona discharge occurring near a high-voltage transformer or a discharge lamp is detected at its very start for protection of the circuit (refer to, for example, Japanese Patent Application Laid-Open No. 2002-341775). Such a discharge lamp driving circuit includes an induction pattern for a transformer, and another induction pattern for a discharge lamp, and voltages induced in the induction patterns are detected for protection of an inverter circuit.

FIG. 2 is a block diagram showing a discharge lamp driving circuit 60 disclosed in the aforementioned Japanese Patent Application Laid-Open No. 2002-341775. The discharge lamp driving circuit 60 has an induction pattern 62 for a transformer shaped into an elongated rectangle and disposed at an area in the lower face of a printed circuit board corresponding to a high-voltage transformer 61, and an induction pattern 64 for a discharge lamp shaped into a rectangle and disposed at an areas in the lower face of a printed circuit board corresponding a discharge lamp 63. When a corona discharge occurs at the transformer 61 or the discharge lamp 63, voltages induced at the induction patterns 62, 64 become high-frequency currents and are compared with respective reference voltages at corona discharge detecting circuits 65, 66. If the induced voltages are lower than the reference voltages, a signal is outputted so as to deactivate a switching transistor for protection of the circuit 60.

Since the discharge lamp driving circuit as described above is formed on a printed circuit board which is dimensioned substantially as large as a light conductive plate disposed on the bottom face of a liquid crystal cell, the printed circuit board has to be inevitably dimensioned as large as the liquid crystal cell. Consequently, in a large LCD apparatus used in, for example, a large TV, a large printed circuit board must be used in accordance with the size of the liquid crystal cell, which results in an increased cost of the discharge lamp driving circuit. Also, respective induction patterns must be disposed for a transformer and a discharge lamp thus constituting another factor for an increased cost. Further, since a plurality of transformers and discharge lamps are provided in a large LCD apparatus, typically in a liquid crystal TV, a plurality of induction patterns must be provided for a transformer and a discharge lamp, respectively, which results in requirement of a number of induction patterns, and also which makes the induction pattern arrangement difficult.

SUMMARY OF THE INVENTION

The present invention has been made in light of the above problems, and it is an object of the present invention to provide a discharge lamp driving circuit which is deactivated upon detection of a discharge occurring at a wiring at the secondary side of a high-voltage transformer, and which is produced inexpensively for use in a large LCD apparatus.

In order to achieve the object described above, according to one aspect of the present invention, in a discharge lamp driving circuit comprising: a control circuit; a transformer having one end of at least one discharge lamp connected to one end of a secondary side thereof; a transformer driving circuit to drive a primary side of the transformer for lighting the at least one discharge lamp; a current-voltage converting circuit provided at the other end of the at least one discharge lamp and functioning to convert a lamp current to a voltage; and a lamp current controlling pattern provided at the other end of the at least one discharge lamp, there is provided a discharge detecting pattern at a grounding end of the secondary side of the transformer so as to be located close to and in parallel with the lamp current controlling pattern, whereby a voltage induced at the discharge detecting pattern is detected thereby stopping supply of electric power to the secondary side of the transformer. With the structure described above, a corona discharge or an arc discharge can be detected through a voltage induced in the discharge detecting pattern by a high-frequency noise component of the lamp current flowing in the lamp current controlling pattern, whereby the discharge lamp driving circuit is deactivated and protected.

In the one aspect of the present invention, the lamp current controlling pattern and the discharge detecting pattern may be formed on one same surface of a printed circuit board. Consequently, if they are formed on the same surface that has electronic components such as the control circuit, the transformer, and the transformer driving circuit formed thereon, then the patterning work can be done coincidentally with the circuit wiring work thereby improving the working process.

In the one aspect of the present invention, the lamp current controlling pattern and the discharge detecting pattern may be formed in a zigzag line. Consequently, the pattern inductance can be arbitrarily adjusted for detecting with an enhanced efficiency.

In the one aspect of the present invention, more than one discharge lamp may be connected to the secondary side of the transformer. Thus, multiple discharge lamps can be lighted simultaneously.

DETAILED DESCRIPTION OF THE PREFERRED EMBODIMENTS

Preferred embodiments of the present invention will hereinafter be described with reference to the accompanying drawings.

Figure 3:
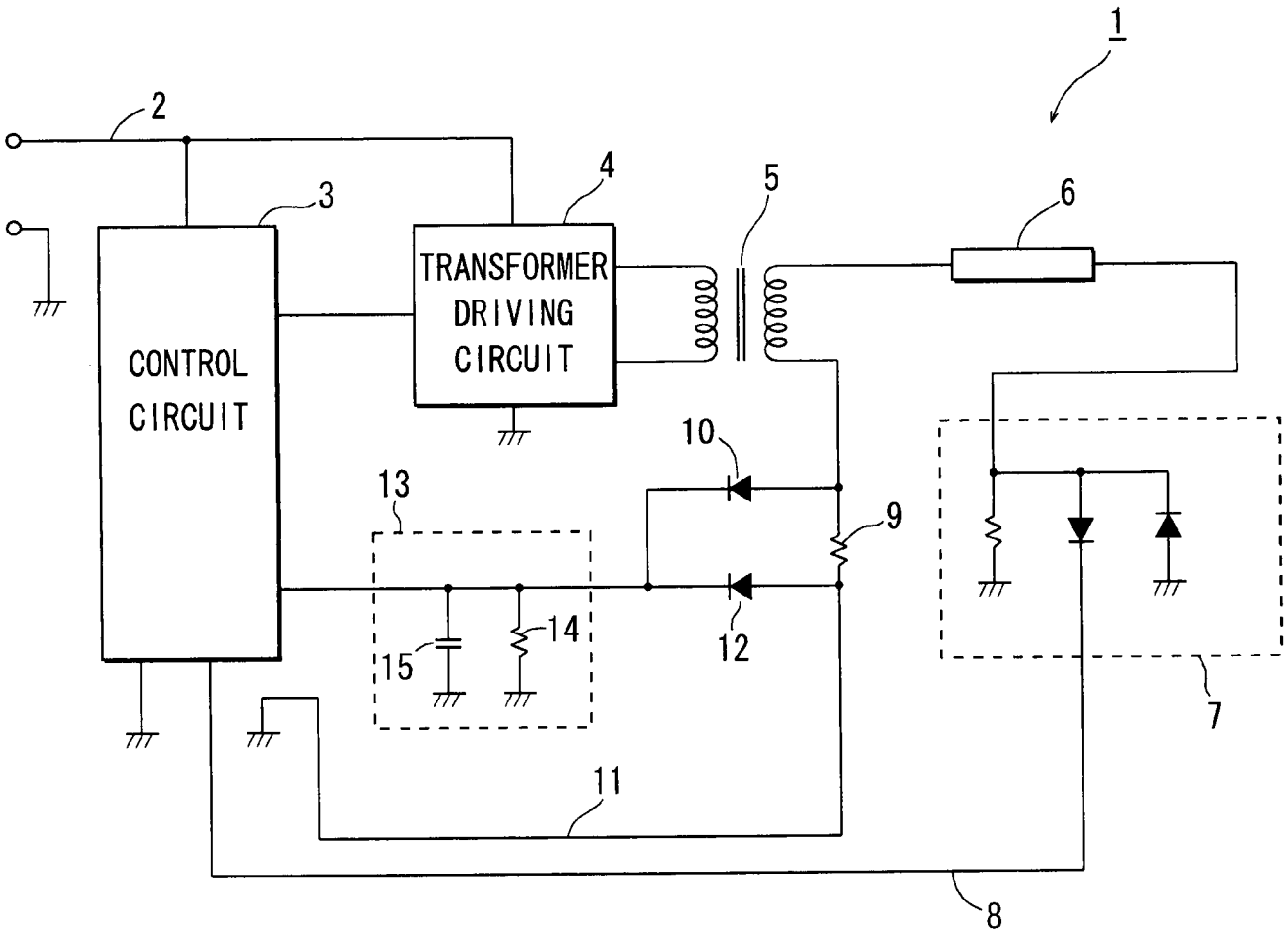
FIG. 3 is a block diagram showing a discharge lamp driving circuit according to a first embodiment of the present invention.

Referring to FIG. 3, in a discharge lamp driving circuit 1 according to a first embodiment of the present invention, a transformer driving circuit 4 is connected to the primary side of a transformer 5 and drives the primary side of the transformer 5, and a control circuit 3 to control the discharge lamp driving circuit 1 is connected to the transformer driving circuit 4, has an oscillation circuit to set a drive frequency for driving the primary side of the transformer 5, and outputs a control signal sent to the transformer driving circuit 4.

Figure 1:
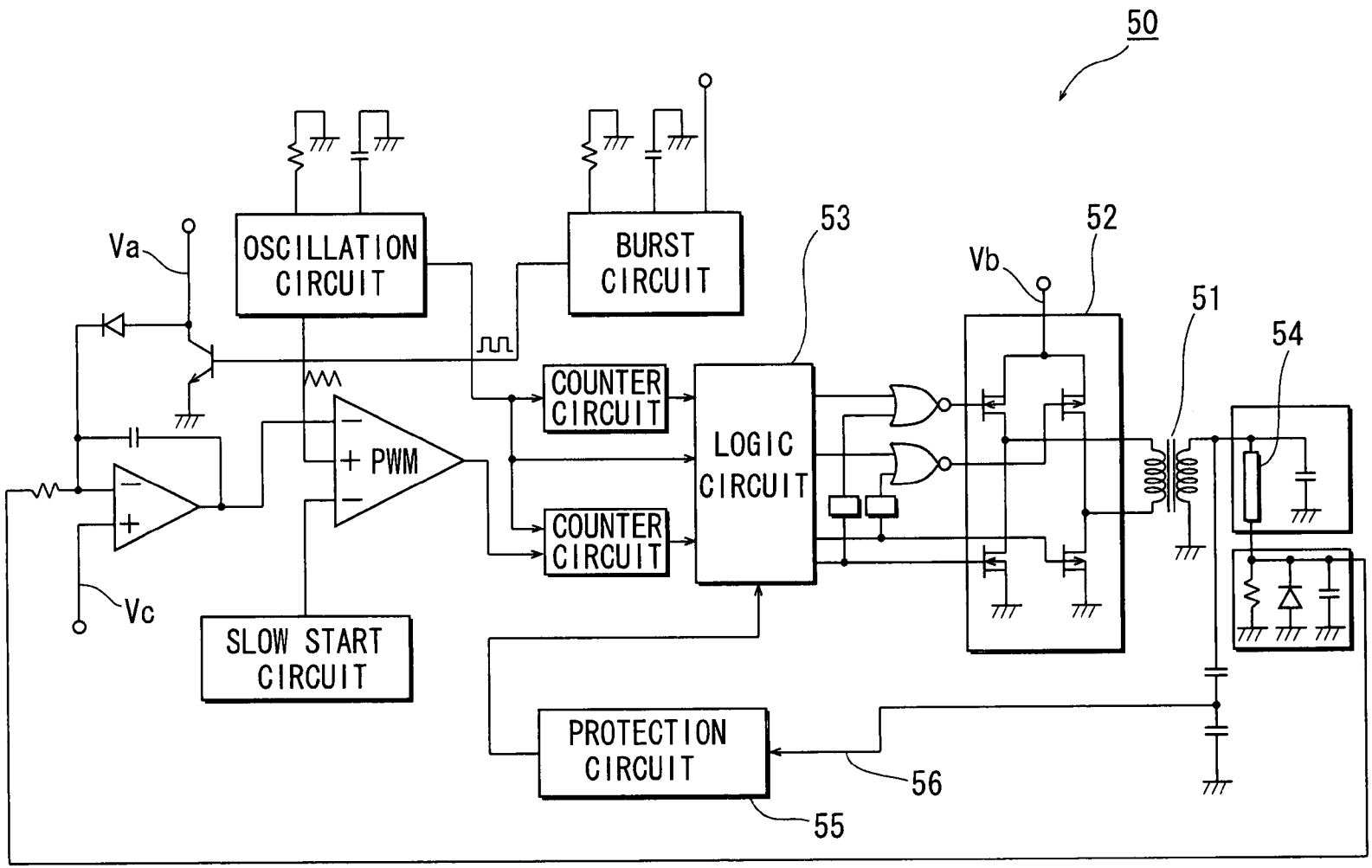
FIG. 1 PRIOR ART
FIG. 1 is a block diagram showing a conventional discharge lamp driving circuit.
Figure 2:
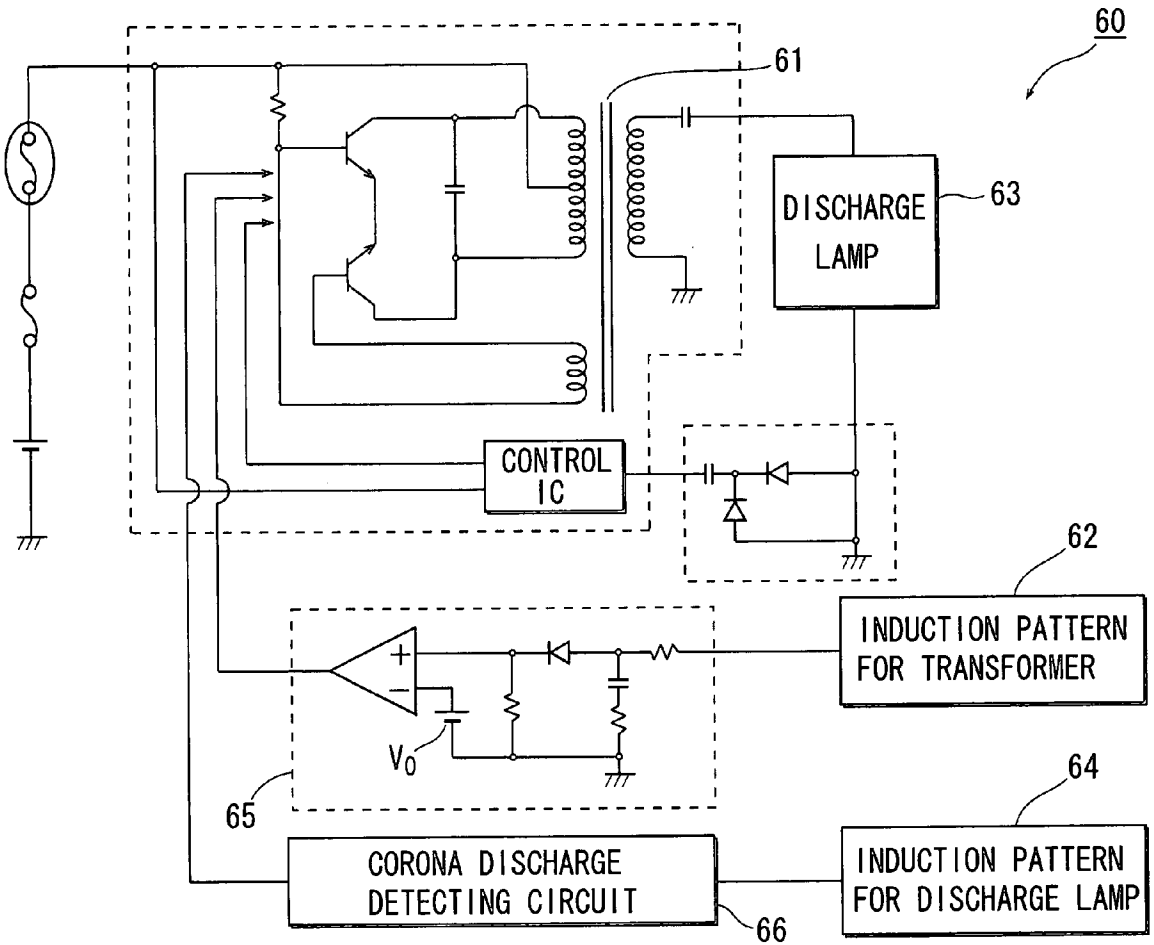
FIG. 2 PRIOR ART
FIG. 2 is a block diagram showing another conventional discharge lamp driving circuit.

The transformer driving circuit 4 has switching elements to drive the primary side of the transformer 5. For example, if an H-bridge is constituted by four switching elements as shown in FIG. 1, an output signal from the control circuit 3 becomes a gate signal and is inputted into the H-bridge so as to switch the four switching elements at a predetermined time interval thereby generating an alternating voltage which lights a discharge lamp 6 connected to the secondary side of the transformer 5. An input voltage line 2 is connected to the control circuit 3 and the transformer driving circuit 4.

The transformer driving circuit 4 is not limited to the H-bridge as shown in FIG. 1, but may be a half-bridge, or any circuit as long as switching elements to drive the primary side of the transformer 5 are provided.

The discharge lamp 6 connected to the secondary side of the transformer 5 constitutes a backlight system for use in an LCD apparatus, and may be, for example, a cold cathode lamp. One end of the discharge lamp 6 is connected to the secondary side of the transformer 5 as described above while the other end thereof is connected to a current-voltage converting circuit 7 to convert a lamp current flowing in the discharge lamp 6 into a voltage, and an output signal from the current-voltage converting circuit 7 is sent to the control circuit 3 via a lamp current controlling pattern 8 connected to the current-voltage converting circuit 7. With the output signal from the current-voltage converting circuit 7, the control circuit 3 controls the lamp current flowing in the discharge lamp 6 for keeping the current constant.

An overcurrent detecting resistor 9 and an overcurrent detecting diode 10 are connected to the grounding end of the secondary side of the transformer 5, and the control circuit 3 is connected to the overcurrent detecting resistor 9 and the overcurrent detecting diode 10. Also, a discharge detecting pattern 11 is provided at the grounding end so as to be located close to and in parallel with the lamp current controlling pattern 8, and one end of the discharge detecting pattern 11 is connected to a discharge detecting diode 12 while the other end thereof is grounded.

Description will hereinafter be made on a discharge detecting operation in case of a corona discharge or an arc discharge occurring at a partially broken wire at the secondary side of the transformer 5.

When a corona discharge or an arc discharge occurs at a partially broken wire at the secondary side of the transformer 5, a noise component gets in a lamp current. Since the noise component resulting from the discharge contains a high-frequency component, magnetic flux which is generated by the high-frequency component in the lamp current controlling pattern 8 is caused to change rapidly.

The change of the magnetic flux has influence on the discharge detecting pattern 11 disposed parallel to the lamp current controlling pattern 8, and a spike-like induced voltage is generated in the discharge detecting pattern 11. The induced voltage goes through the discharge detecting diode 12, and an integration circuit 13 composed of a resistor 14 and a capacitor 15, and is inputted in a comparison circuit provided in the control circuit 3 and compared thereat with a predetermined reference voltage. If the induced voltage exceeds the reference voltage, then the comparison circuit outputs a signal to deactivate the oscillation circuit provided in the control circuit 3 thereby stopping the corona discharge or the arc discharge from going on. Thus, the discharge lamp driving circuit 1 can be protected.

The discharge detecting pattern 11 is preferably disposed as close to the lamp current controlling pattern 8 as possible so that the corona discharge or the arc discharge can be detected with an increased sensitivity. Also, the dimension of the parallel disposition of the discharge detecting pattern 11 with respect to the lamp current controlling pattern 8 should be as large as possible for an increased sensitivity.

The discharge detecting pattern 11 and the lamp current controlling pattern 8 may be formed on either surface of a printed circuit board (not shown), for example such that the discharge detecting pattern 11 is formed on an area of one surface of the printed circuit board corresponding to an area of the other surface having the lamp current controlling pattern 8 formed thereon, but if they are both formed on a surface thereof having electronic components such as the control circuit 3, the transformer driving circuit 4, and the transformer 5 disposed thereon, then the patterning work can coincide with the circuit wiring work thus improving the working process.

The discharge detecting pattern 11 does not have to be formed in a straight line but alternatively in a zigzag line, or in a twisted line using through-holes in the printed circuit board (not shown). When the discharge detecting pattern 11 is formed in a zigzag line, the pattern inductance can be adjusted appropriately for detecting discharge with an enhanced efficiency.

Figure 4:
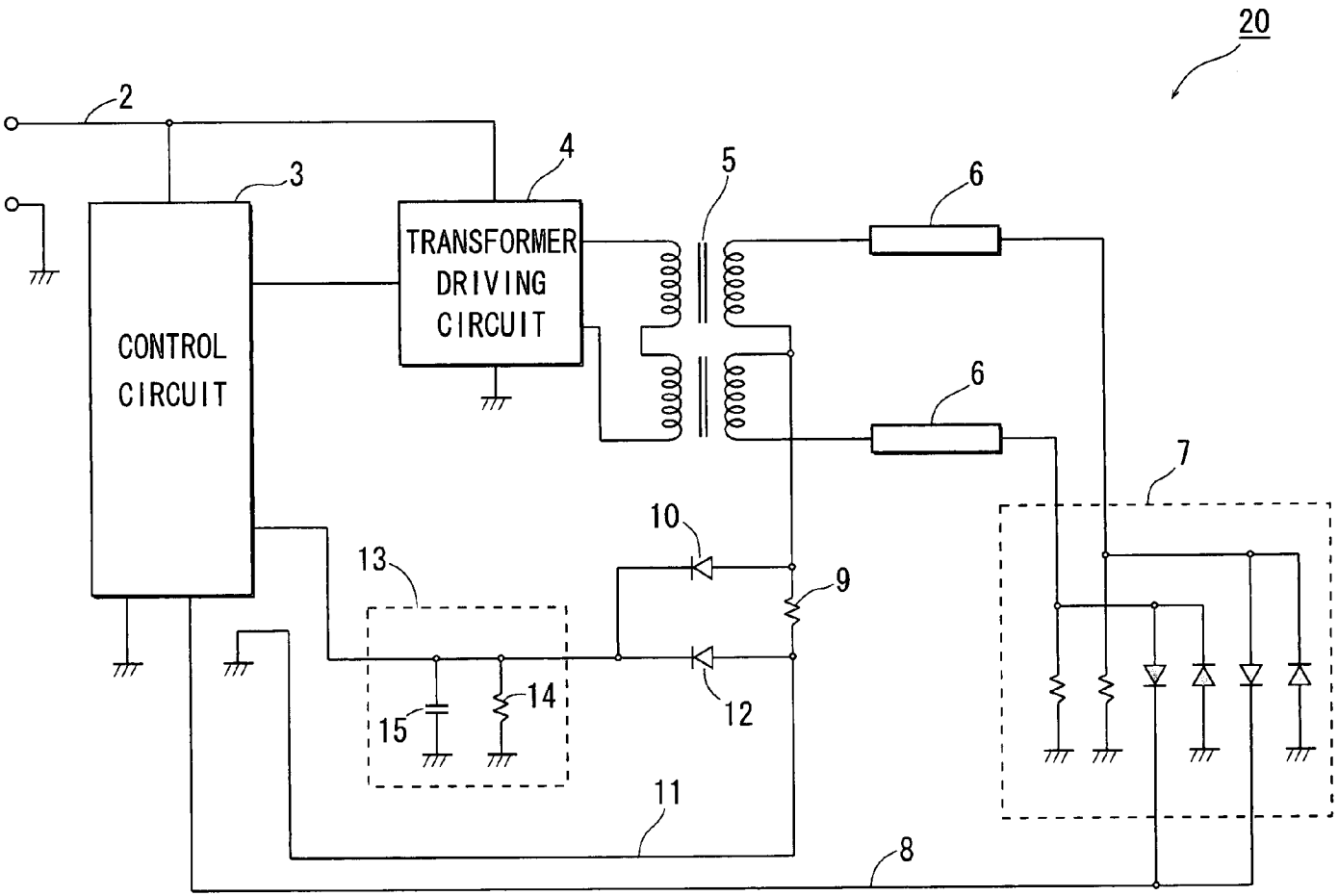
FIG. 4 is a block diagram showing a discharge lamp driving circuit according to a second embodiment of the present invention.

Referring now to FIG. 4, a discharge lamp driving circuit 20 according to a second embodiment of the present invention is adapted to drive two discharge lamps 6 connected to the secondary side of a transformer 5. The discharge lamp driving circuit 20 operates in the same way as the discharge lamp driving circuit 1 of the first embodiment, and a description thereof will be omitted.

Figure 5:
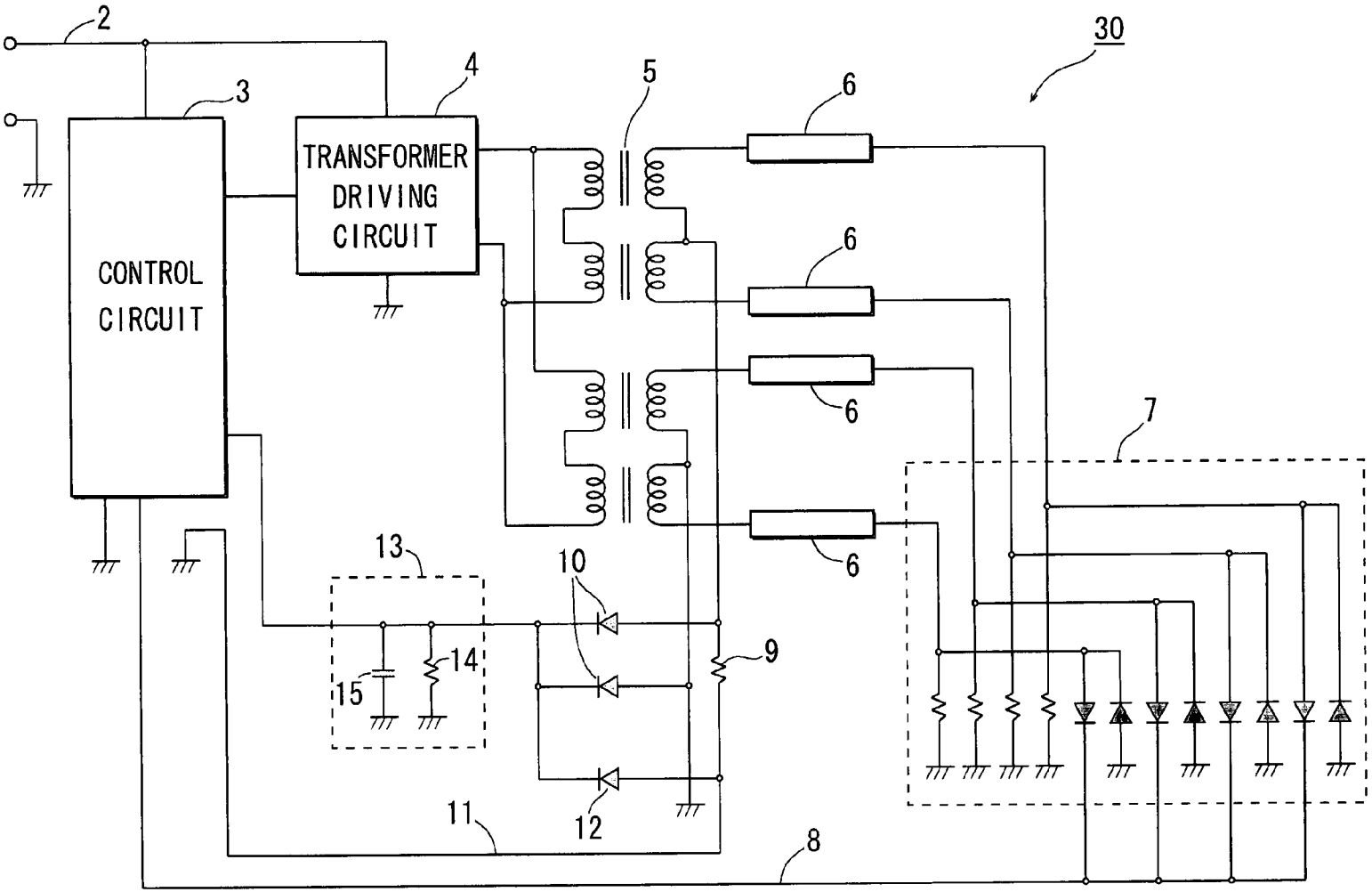
FIG. 5 is a block diagram showing a discharge lamp driving circuit according to a third embodiment of the present invention.

Referring then to FIG. 5, a discharge lamp driving circuit 30 according to a third embodiment of the present invention is adapted to drive more than two (four in the figure) discharge lamps 6 connected to the secondary side of a transformer 5. The discharge lamp driving circuit 30 operates in the same way as the discharge lamp driving circuit 1 of the first embodiment, and a description thereof will be omitted.

Figure 6:
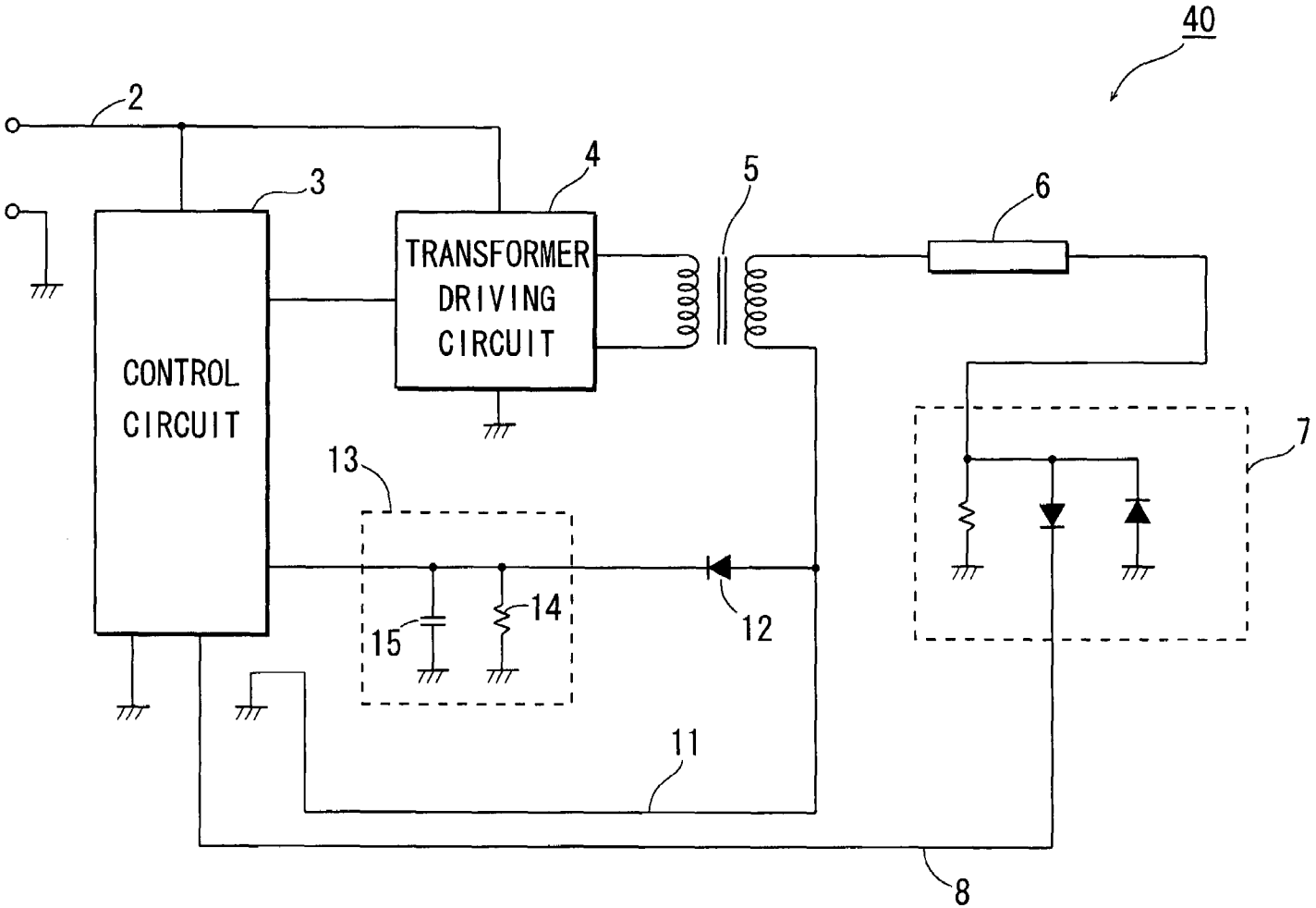
FIG. 6 is a block diagram showing a discharge lamp driving circuit according to a fourth embodiment of the present invention.

Referring finally to FIG. 6, a discharge lamp driving circuit 40 according to a fourth embodiment of the present invention is structured in the same way as the discharge lamp driving circuit 1 of the first embodiment except that the overcurrent detecting resistor 9 and the overcurrent detecting diode 10 are not provided. That is to say, only a discharge detecting function is provided at the grounding end of the secondary side of a transformer 5. The discharge lamp driving circuit 40 operates in the same way as the discharge lamp driving circuit 1 of the first embodiment, and a description thereof will be omitted.

Obviously, many modifications and variations of the present invention are possible in light of the above teachings. Thus, it is to be understood that, within the scope of the appended claims, the invention may be practiced otherwise than as specifically described above.

What is claimed is:

1. A discharge lamp driving circuit comprising:

a transformer having a primary side and a secondary side, a non-grounded side of the secondary side of the transformer being connected to one end of at least one discharge lamp;

a transformer driving circuit connected to the primary side of the transformer;

a control circuit connected to the transformer driving circuit;

a current-voltage converting circuit arranged at the secondary side of the transformer and functioning to convert a current flowing in the secondary side of the transformer to a voltage, wherein an output signal from the current-voltage converting circuit is supplied to the control circuit through a lamp current controlling pattern connected to the current-voltage converting circuit; and a discharge detecting pattern, arranged between a grounded side of the secondary side of the transformer and ground, wherein a voltage induced at the discharge detecting pattern is detected thereby stopping supply of electric power to the secondary side of the transformer.

2. A discharge lamp driving circuit comprising:

a control circuit;

a transformer having one end of at least one discharge lamp connected to one end of a secondary side thereof;

a transformer driving circuit to drive a primary side of the transformer for lighting the at least one discharge lamp;

a current-voltage converting circuit provided at the other end of the at least one discharge lamp and functioning to convert a lamp current to a voltage;

a lamp current controlling pattern provided at the other end of the at least one discharge lamp; and a discharge detecting pattern provided at a grounding end of the secondary side of the transformer so as to be located close to and in parallel with the lamp current controlling pattern, wherein a voltage induced at the discharge detecting pattern is detected thereby stopping supply of electric power to the secondary side of the transformer, wherein the lamp current controlling pattern and the discharge detecting pattern are formed on one same surface of a printed circuit board.

3. A discharge lamp driving circuit according to claim 1, wherein the lamp current controlling pattern and the discharge detecting pattern are formed in a zigzag line.

4. A discharge lamp driving circuit comprising:

a control circuit;

a transformer having one end of at least one discharge lamp connected to one end of a secondary side thereof;

a transformer driving circuit to drive a primary side of the transformer for lighting the at least one discharge lamp;

a current-voltage converting circuit provided at the other end of the at least one discharge lamp and functioning to convert a lamp current to a voltage;

a lamp current controlling pattern provided at the other end of the at least one discharge lamp; and a discharge detecting pattern provided at a grounding end of the secondary side of the transformer so as to be located close to and in parallel with the lamp current controlling pattern, wherein a voltage induced at the discharge detecting pattern is detected thereby stopping supply of electric power to the secondary side of the transformer, wherein a plurality of discharge lamps are connected to the secondary side of the transformer.

5. A discharge lamp driving circuit according to claim 1, wherein the lamp current controlling pattern and the discharge detecting pattern are formed on one same surface of a printed circuit board.

6. A discharge lamp driving circuit according to claim 1, wherein a plurality of discharge lamps are connected to the secondary side of the transformer.

7. A discharge lamp driving circuit according to claim 1, wherein the discharge detecting pattern is arranged close to and in parallel with the lamp current controlling pattern.

8. A discharge lamp driving circuit according to claim 1, wherein one end of the discharge detecting pattern is coupled with the grounded side of the secondary side of the transformer, and the other side of the discharge detecting pattern is grounded.

9. A discharge lamp driving circuit according to claim 1, wherein the current-voltage converting circuit is arranged at a grounded side of the at least one discharge lamp.

10. A discharge lamp driving circuit according to claim 1, wherein the discharge lamp is a cold cathode lamp.

11. A discharge lamp driving circuit according to claim 1, wherein the discharge lamp driving circuit is used in a backlight system for a liquid crystal display apparatus.

12. A discharge lamp driving circuit according to claim 2, wherein a plurality of discharge lamps are connected to the secondary side of the transformer.

13. A discharge lamp driving circuit according to claim 2, wherein the discharge detecting pattern is arranged close to and in parallel with the lamp current controlling pattern.

14. A discharge lamp driving circuit according to claim 2, wherein the discharge lamp is a cold cathode lamp.

15. A discharge lamp driving circuit according to claim 2, wherein the discharge lamp driving circuit is used in a backlight system for a liquid crystal display apparatus.

16. A discharge lamp driving circuit according to claim 2, wherein the lamp current controlling pattern and the discharge detecting pattern are formed in a zigzag line.

17. A discharge lamp driving circuit according to claim 4, wherein the lamp current controlling pattern and the discharge detecting pattern are formed on one same surface of a printed circuit board.

18. A discharge lamp driving circuit according to claim 4, wherein the discharge detecting pattern is arranged close to and in parallel with the lamp current controlling pattern.

19. A discharge lamp driving circuit according to claim 4, wherein the discharge lamp is a cold cathode lamp.

20. A discharge lamp driving circuit according to claim 4, wherein the discharge lamp driving circuit is used in a backlight system for a liquid crystal display apparatus.

* * * * *